US011691044B2

(12) United States Patent
Zaykov et al.

(10) Patent No.: US 11,691,044 B2
(45) Date of Patent: Jul. 4, 2023

(54) FITNESS DEVICE FOR TRAINING THE WHOLE BODY

(71) Applicants: Georgi Ivanov Zaykov, Sandanski (BG); Ivan Georgiev Zaykov, Sandanski (BG); Tsvetan Georgiev Zaykov, Sandanski (BG)

(72) Inventors: Georgi Ivanov Zaykov, Sandanski (BG); Ivan Georgiev Zaykov, Sandanski (BG); Tsvetan Georgiev Zaykov, Sandanski (BG)

( * ) Notice: Subject to any disclaimer, the term of this patent is extended or adjusted under 35 U.S.C. 154(b) by 0 days.

(21) Appl. No.: 17/490,837

(22) Filed: Sep. 30, 2021

(65) Prior Publication Data

US 2022/0105377 A1 Apr. 7, 2022

(30) Foreign Application Priority Data

Oct. 1, 2020 (BG) ..... 113237

(51) Int. Cl.
*A63B 5/16* (2006.01)
*A63B 23/04* (2006.01)

(52) U.S. Cl.
CPC ..... *A63B 5/16* (2013.01); *A63B 23/0405* (2013.01); *A63B 2023/0411* (2013.01); *A63B 2209/08* (2013.01); *A63B 2225/093* (2013.01)

(58) Field of Classification Search
CPC ..... A63B 5/16; A63B 23/0405; A63B 2023/0411; A63B 2209/08; A63B 2225/093; A63B 2022/0092; A63B 2071/0063; A63B 2071/0081; A63B 71/0054; A63B 5/22
See application file for complete search history.

(56) References Cited

U.S. PATENT DOCUMENTS 5,961,425 A * 10/1999 Reid ..... A63B 5/20 482/81
10,188,889 B2 1/2019 Zaykov et al.
2002/0123413 A1* 9/2002 Reid ..... A63B 5/20 482/81
2017/0173377 A1* 6/2017 Zaykov ..... A63B 71/0054
2020/0101343 A1* 4/2020 Gonzales ..... A63B 5/16

FOREIGN PATENT DOCUMENTS

BG 3275 U1 10/2019

* cited by examiner

*Primary Examiner* — Andrew S Lo
(74) *Attorney, Agent, or Firm* — Maier & Maier, PLLC

(57) ABSTRACT

ABSTRACT OF THE DISCLOSURE
A fitness device for training the whole body. The device has coaxially arranged one above the other tubular elements of the same diameter, and an inner body disposed in cavities defined by the tubular elements. At the base of the inner body is a drive motor, providing rotational movement of the lower tubular element and the part of the inner body disposed in its cavity, which transmits the rotational movement and of the part of the inner body disposed in the cavity, by a spindle, at least two obstacles with identical construction respectively lower and upper, each magnetically connected to a sliding means, respectively detachably connected to sliders and of the inner body and a cover.

13 Claims, 9 Drawing Sheets

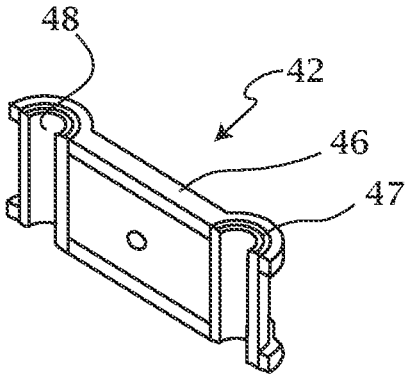
FIG. 12
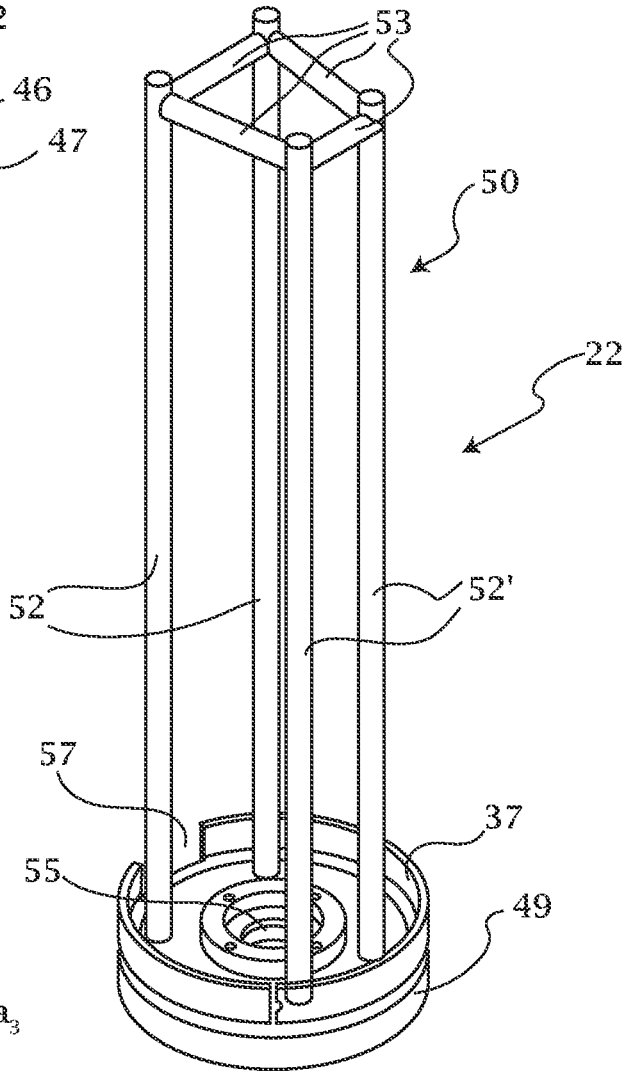
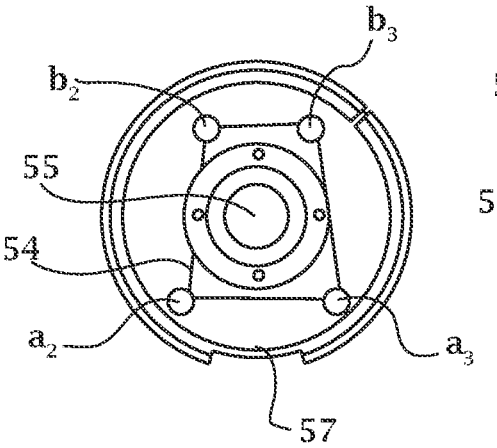
FIG. 14
FIG. 13

FITNESS DEVICE FOR TRAINING THE WHOLE BODY

FIELD

The invention relates to a fitness device for training a whole body, in particular from the category of light strength training machine for whole body and can be used in gyms and indoor and outdoor premises.

BACKGROUND

The known fitness devices for training a whole body, or so-called fitness training machine, work on different principles, for example training by reflexive muscle contraction, with the whole body or parts of it are being subjected to vibrations, such as, for example, the different types vibrating training machine, or muscle training by running, such as cross-training machine with targeted tasks, or so-called "power cable columns", offering many different in type and strength exercises for muscle training, affecting different separate parts of the human body, individually. A common disadvantage of all known training machines for the whole body is that they are a passive devices, in which the effectiveness of the training process depends exclusively on the will of the trainee and are mainly for training muscles. Another known fitness device for training a whole body, which is of a newer type, is described in patent U.S. Pat. No. 10,188,889 and Certificate of registration of utility model BG No. 3275 U1. The device operates on the principle of forced performance by the trainee of jumps and squats from a spot alternating in consistently, in response to continuously passing through the spot of the alternating consistently and alternative obstacles, such as a lower obstacle that obligates the performance of jumping and an upper obstacle that obligates the performance of squatting, i.e. the device is active and stimulates the training process, in which not only all the muscles of the body are trained at the same time, but also achieves and an effect of functional and condition level of training, endurance training, agility, motor reaction, concentration of the attention and coordination, as well as general physical and organ strengthening. Said obstacles are located diametrically opposite to each other and at a distance from each other, in respect to the vertical axis of the device, which is commensurate with the human height. The obstacles are fixedly connected to a body that performs rotational movement which is located externally on a fixed support console. The body performing the rotational movement of the obstacles includes two interconnected sleeves, respectively for the lower and for the upper obstacle, located on the fixed console. Although the device from patent U.S. Pat. No 10,188,889 and utility model BG No. 3275 U1 fully achieves the idea set by the authors for functional and conditioning training of the whole body with the help of a device actively involved in the training process, the inconvenience of this design comes from the external position of the body, providing the rotational movement of obstacles, which favors the negative effects of the environment, such as pollution. In addition, the device is complex to implement and with a large area of friction surfaces. On the other hand, stationary protruding obstacles in working and non-working position, to some extent, impair the aesthetic appearance of the device.

SUMMARY

The object of the present invention is an improvement of the structure of the device of patent U.S. Pat. No. 10,188,889 and the utility model BG No. 3275 U1 with regard to the part providing the rotational movement of the obstacles, its simplification and providing the maximum possible encapsulation of the body, ensuring the rotational movement of the obstacles, as well as the aesthetic improvement of the appearance of the fitness device according to the invention.

To achieve the above goal, an object of the invention became to create a body providing rotational movement of the obstacles embedded inside the cavity, formed by tubular elements, with the possibility of attaching the obstacles themselves only in the mode of operation of the fitness device according to the invention.

The task is solved by a fitness device for training the whole body, by jumping and squats from a spot, including a base plate defining the place of attachment of the device, a drive motor located at the base of the device, a lower obstacle, obliging to perform a jump and an upper obstacle, obliging to perform a squat, as the obstacles perform an one-way rotational movement around the vertical axis of the device, are located diametrically opposite to each other at an angle of 180° to the axis and are vertically spaced one to other at a distance commensurate with the human height, which is characterized with this, that also includes:

- coaxially arranged one above the other rigid tubular element, a lower tubular element and an upper tubular element with the same diameter,
- an inner body located in the cavities defined by the tubular elements, at the base of which is situated a drive motor, providing the rotational movement of the lower tubular element and the part of the inner body located in its cavity by means of a gear connected to the motor shaft;
- at least two obstacles such as a lower obstacle magnetically connected to a sliding means and an upper obstacle also magnetically connected to a sliding means, as the sliding means being detachably connected to the inner body; and
- a cover situated internally at the open end of the upper tubular element, isolating the inner body from the environment.

In that, the lower obstacle and the upper obstacle have identical constructive embodiment, including a tubular arm, one end of which is provided with a magnet and a two-layer case consisting of a sponge enveloping the tubular arm, as the sponge partially extending beyond its free end and is covered with leather or fabric, so that the total length of the obstacle to be in the range of 100-120 mm and the best 115 mm.

The sliding means is a L-shaped body with a long arm in the shape of a parallelepiped and a short arm in the same shape, joined monolithically at 90 degree angles, as the long arm having a length of not more than 400 mm, within which the magnet is optionally attached, in accordance with the selected height of the obstacle suspension, and the front surface of the short arm is provided with a plate for connection to the inner body, as the L-shaped sliding means being made of low-carbon steel.

The lower tubular element and the upper tubular element are provided with a U-shaped slot with a width and length corresponding to the width and length of the long arm of the sliding means.

The task is also solved and by this that the inner body includes a base chassis situated in the cavity defined by the fixed tubular element, a lower sub-frame situated in the cavity defined by the lower tubular element and an upper sub-frame situated in the cavity defined. from the upper tubular element.

In that, the base chassis includes a drive motor mounting kit consisting of a base plate, a limiting ring situated on it, a gear mounting plate connected to a support beam by means of an angular tube-plate connection and a pair of legs, connected by one side with the limiting ring and on the other with the gear mounting plate.

The limiting ring is composed by a ring part standing vertically, provided with a slot for accommodating the sliding means when sliding it down and by a ring part at a 90 degree angle to it, fastened to the base plate, The task is also solved and with this that the lower sub-frame includes a lower base plate receiving the rotational movement of the gear, a welded structure connected to the lower base plate, a spindle located in a central hole of the base plate to which the lower end of the lower tubular element is attached.

The welded structure contains a pair of vertical pipes the lower ends of which are situated in clamping cylinders of the slider and are welded in holes b, $b_1$ on the lower base plate and a U-shaped truss the lower ends of which are welded in holes a, $a_1$ on the lower base plate, such as the angular distance between the holes a-$a_1$, the angular distance between the holes b-$b_1$, the distance between the peripheral circle "c" of the base plate and the imaginary circle "d" passing through the center of the holes a-$a_1$ and the distance between the peripheral circle "c" of the base plate and the imaginary circle "$d_1$" passing through the center of the holes b-$b_1$ are set so that the transverse beam of the U-shaped truss can reach the upper ends of the pair of vertical pipes and be welded to them.

The task is also solved and with this, that the upper sub-frame includes an upper base plate with a central hole and a limiting ring connected to the lower end of the upper tubular element and with the spindle situated in the central hole, a second welded structure situated on the base plate and provided with a second slider detachably connected to the sliding means on a place diametrically opposite to the place of the slider from the lower sub-frame, as the limiting ring being provided with a cut-out corresponding to the attachment place of the second slider.

The second welded structure consists of two pairs of tubes, a first pair and a second pair, situated parallel to each other and at a distance defined by holes $a_2$-$a_3$ on the upper base plate with welded in them the lower ends of the first pair of tubes and by holes $b_2$-$b_3$ of the upper base plate with welded in them the lower ends of the second pair of tubes, the upper ends of the two pairs of tubes are connected to each other in sequential order by means of crossbeams so that the transverse beams form a ring with a form of irregular quadrilateral, defined by the disposition of the openings $a_2$-$a_3$ against the cut-out, but outside its range.

The task is also solved by manually and individually adjusting the height of the suspension of the obstacles, by change the place of the connection "sliding means-magnet" with respect to the lower obstacle and, respectively. "sliding means-magnet" with respect to the upper obstacle and/or by change of the place of "sliding means-slider" connection with respect to the lower obstacle and, resp. "sliding means-second slider" with respect to the upper obstacle, as the range for changing the place of the connections being defined by the length of the long arm of the L-shaped sliding means.

BRIEF DESCRIPTION OF THE FIGURES

The technical features and advantages of the fitness device for exercising the whole body, according to the invention will be better understood in the following description of embodiments, considered together with the accompanying drawings, in which:

FIG. 12 is an axonometric view of ½ of the slider 42;

FIG. 13 is a perspective view of the upper sub-frame of the inner body 18;

FIG. 14 is a top view of the base plate 49 of the upper sub-frame 22;

DETAILED DESCRIPTION

Example 1

Figure 1:
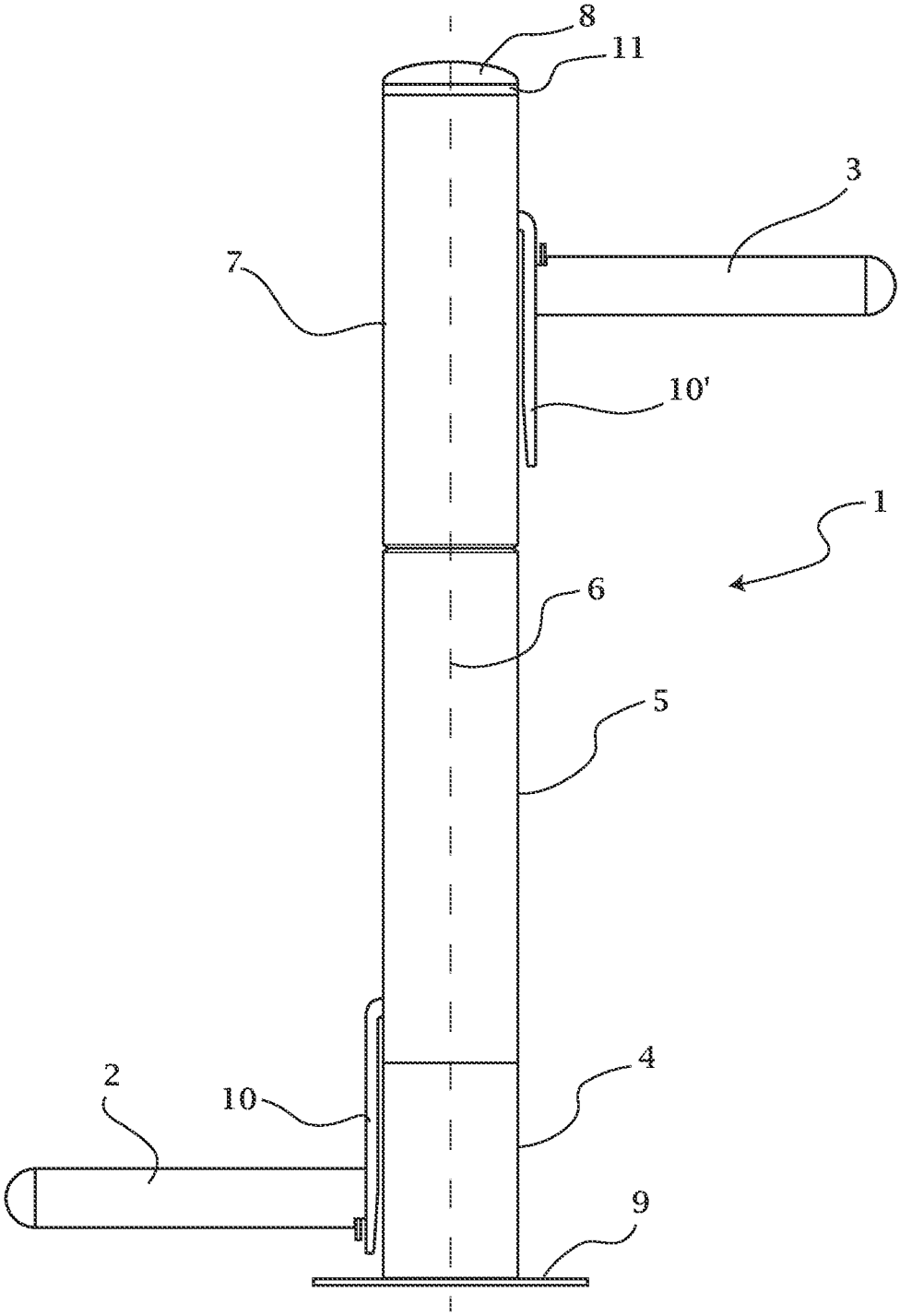
FIG. 1 is a general view of the fitness device (1) in operation mode.

In FIG. 1, a ready-to-use is shown an exemplary embodiment of a fitness device 1 according to the invention for training the whole body by performing a continuous series of "jump" and "squat" movements alternating alternately in response to a continuous and alternative passing through the training place of two diametrically opposite situated and spaced apart with respect to the vertical axis of the device 1, rotating around the axis obstacles, such as the lower obstacle 2 and the upper obstacle 3.

In general, the device 1 according to the invention consists of three tubular elements coaxially arranged one above the other, namely: a fixed tubular element 4 situated at the base of the device 1, a lower tubular element 5 with possibility to rotation around the vertical axis 6 of the device. 1, an upper tubular member 7 with possibility to rotation around the same axis 6 of the device 1, a cover 8 designated for closing the open upper end of the upper tubular element 7 and a main base plate 9, designated for securing the whole device 1 to the chosen place for training and establishing its stable stationary position. The tubular elements 4, 5 and 7 have the same diameter, forming cavities, respectively 4', 5' and 7' in the common space of which an inner body 18 is situated (FIG. 6), providing the rotational movements of the obstacles 2 and 3, of the tubular elements 5 and 7 and of the parts of the inner body 18 situated in the cavities defined by them, as the tubular elements 4, 5 and 7 and the cover 8 of the device being preferably made of plastic in order to lighten the structure.

In the exemplary embodiment of FIG. 1, the lower obstacle 2 and the upper obstacle 3 are shown in working position, i.e. spaced at an angle of 90 degrees to the vertical axis 6 of the device 1 and the outer surface of the tubular elements 5 and 7. Each of the obstacles 2 and 3 is connected to a sliding means 10, resp. 10', as the sliding means 10 being designated for adjusting the suspension height of the lower obstacle 2 and the sliding means 10' being designated for adjusting the height of the suspension of the upper obstacle 3. The two sliding means 10,10' are of identical design and are connected to the inner body 18 (FIG. 6) for their attachment to the device 1 in the mode of use, i.e. the obstacles 2 and 3 are detachable with respect to the sliding means 10, 10' and can be removed in the non-operating mode of the device 1.

The cover 8, in the exemplary embodiment of FIG. 1 has a hemispherical upper surface to the periphery of which is added a cylinder-shaped neck 11 which enters internally into the open upper end of the upper tubular element 7, thus isolating the common inner space 4'+5'+7', defined by the tubular elements 4, 5 and 7 arranged one on top of the other, from the environment and its undesirable impact on the structures located therein. Of course, in addition to the hemispherical shape, the upper surface of the cover 8 may have another suitable shape, e.g. planar or conical, without departing from the scope of this invention.

Figure 2:
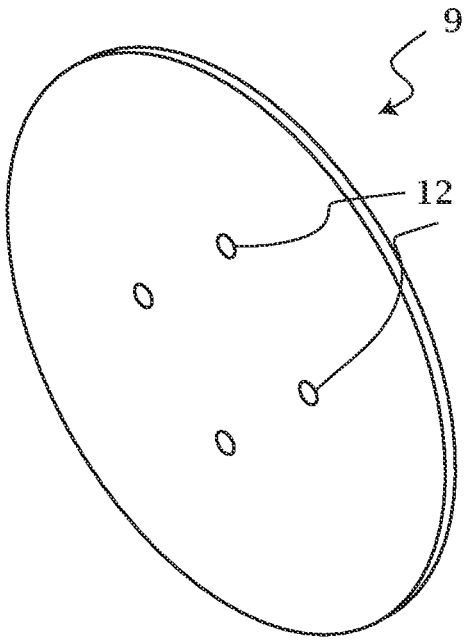
FIG. 2 is an axonometric view of the main base plate 9.

As can be seen in FIG. 2, the main base plate 9 of the device 1 according to the invention is in the form of a cylindrical disk with holes 12 for fastening elements (not shown). To achieve vertical stability of the device 1, the openings 12 are provided in the four corners of an imaginable rectangle situated in the center of the plate 9. The main base plate 9 may have another shape suitable for the vertical stability of the device, as well as a way of fastening without deviating from the scope of the present invention.

Figure 3:
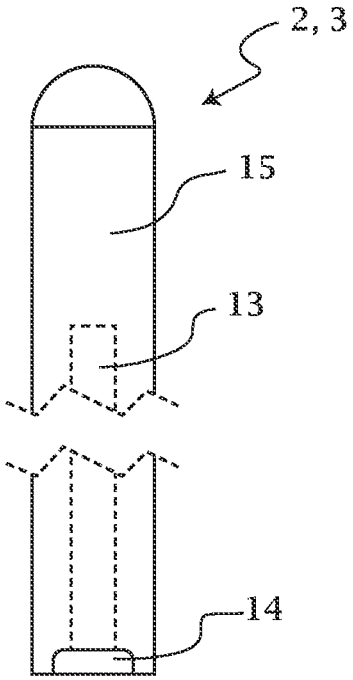
FIG. 3 longitudinal section of the obstacles 2 and 3.

The obstacles 2 and 3 of the device 1 according to the invention (FIG. 3) consist of a tubular arm 13, to one end of which is attached a magnet 14 and of a two-layer case 15 consisting mainly of a sponge which envelops the tubular arm 13 and partially extends it, in order to achieve the required total length of the obstacle from 80 to 120 mm and preferably 115 mm, with the effect of lightening the respective obstacle 2 or 3. The sponge is covered with leather or other material, for example a fabric. Preferably, the tubular arm 13 is made of aluminum, also in order to lighten the obstacles 2, 3.

The magnet 14 provided at the end of the tubular arm 13 is intended to connect the given obstacle 2 or 3 with its corresponding sliding means 10, 10' from the device 1. The provided magnetic connection, as a way of connecting the obstacles 2, 3 with the sliding means 10, 10', allows, in the non-operating mode of the device 1, the obstacles to be easily removed from it, which makes the fitness device according to the invention essentially detachable. The magnet 14 is in the form of a plate with a width corresponding to the width of the sliding means 10,10' to which it adheres under the action of the generated magnetic field between them. In order to obtain the required force of magnetic attraction and force of release of the magnet 14 from the sliding means 10, 10' it has a larger area than that of the cross section of the tubular arm 13, chosen so that when lightly touching the respective obstacle 2 or 3 of the trainee, to detach it from its carrier—the sliding means 10, respectively 10' and fall without injuring the trainee, thanks to it lightweight performance. From the point of view of the training process, the presumption of falling of an obstacle 2 or 3, at its light touch, trains the trainee's attention so that this does not happen, i.e. the concentration of the trainee, so that not only muscles but also brain functions are involved in the training process, which is an exclusive advantage of the device according to the invention. Preferably, the force of separation of the magnet 14 from the sliding means 10 is in the range of 0.1-0.2 Kg.

Figure 4:
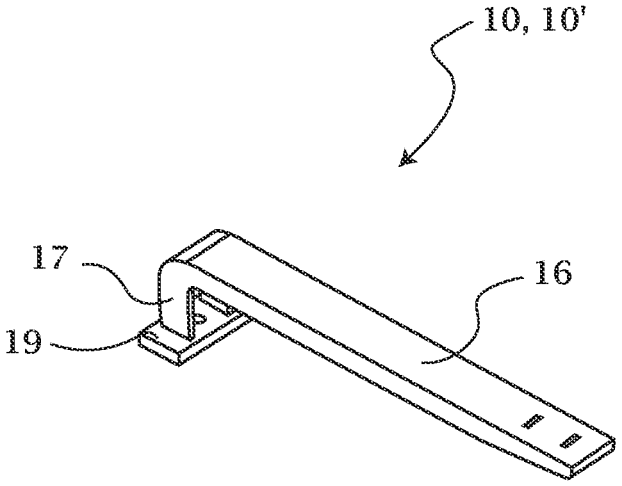
FIG. 4 is a perspective view of the sliding means 10, 10'.

As can be seen in FIG. 4, the sliding means 10, 10' is an L-shaped body, more precisely an Γ-cyrillic, with a long arm 16 in the shape of a parallelepiped and a short arm 17 in the same shape, as the two arms being connected to each other monolithically at right angle obtained for example, by bending or by extrusion of the entire configuration, or in another suitable manner, with which does not depart from the scope of the present invention. The long arm 16 is designated to carry the respective obstacle 2 or 3 at implementation the magnetic connection between its front surface and the front surface of the magnet 14, and the short arm 17 is designated for connection to the inner body 18 (FIG. 6) of the device 1 according to the invention, as will be explained in more detail further. For an implementation the mechanical connection of the sliding means 10, 10' with the inner body 18, the short arm 17 is provided with a fixing plate 19. Of course, in addition to the parallelepiped, the shape of the L-shaped body can be different without, with this, to come out from the scope of this invention, but in any case, it must allow good pairing with the magnet 14.

It is important to note that in order to realize of the magnetic connection between the tubular arm 13 and the sliding means 10,10', the sliding means 10 respectively 10' must be made of a material which can not only be attracted by the magnet, but also which can retain its magnetic properties. Such are, for example, most types of steel or alloys (mixtures of metals). In this case, the sliding means 10,10' is made of steel and in particular of low carbon, i.e. mild steel, including because of its plasticity, which makes it possible to achieve the right angle between the two arms 16 and 17 of the sliding means 10,10'. when this is done, for example, by bending.

Figure 5:
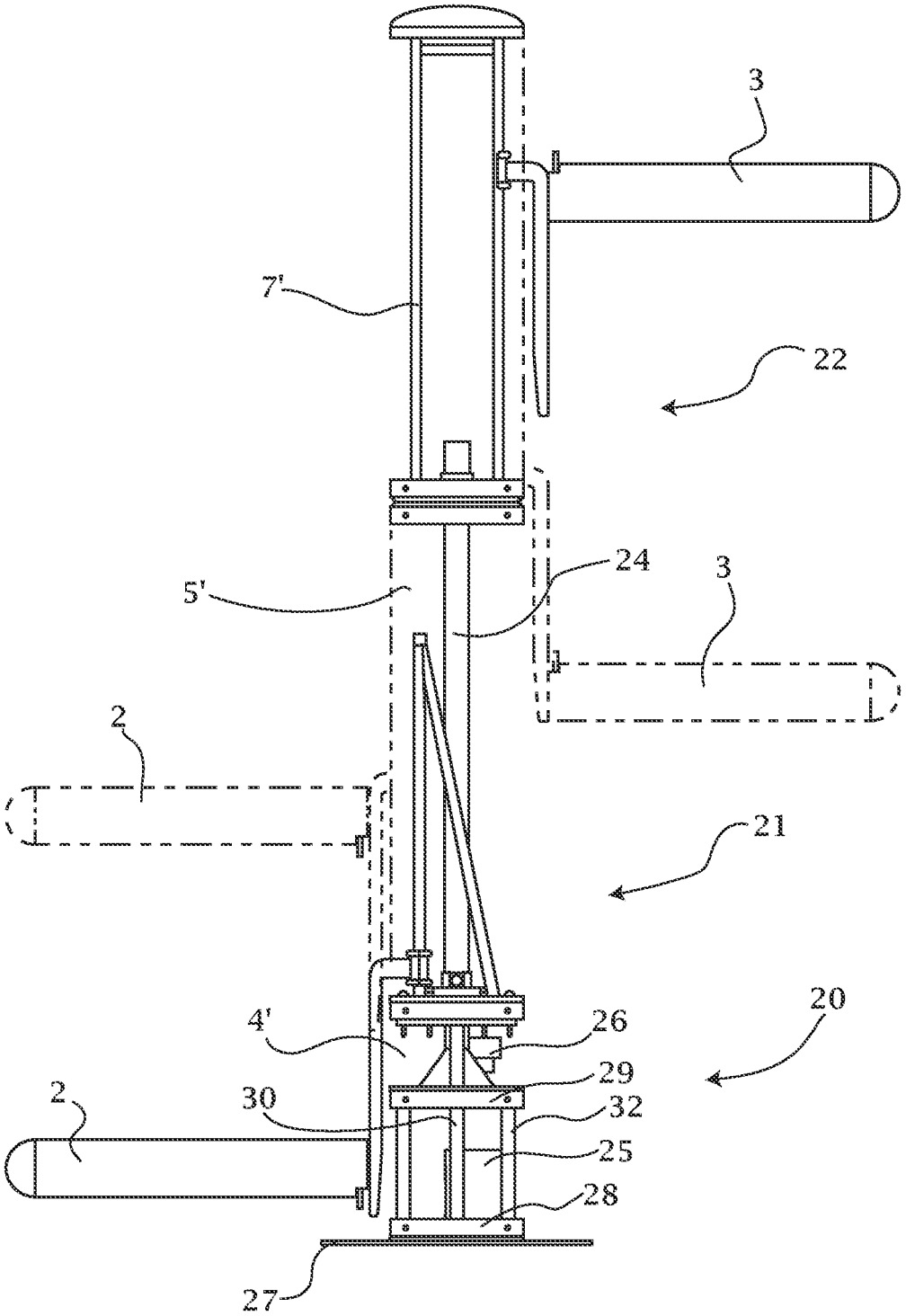
FIG. 5 is a longitudinal section along line A-A of the device 1.
Figure 5A:
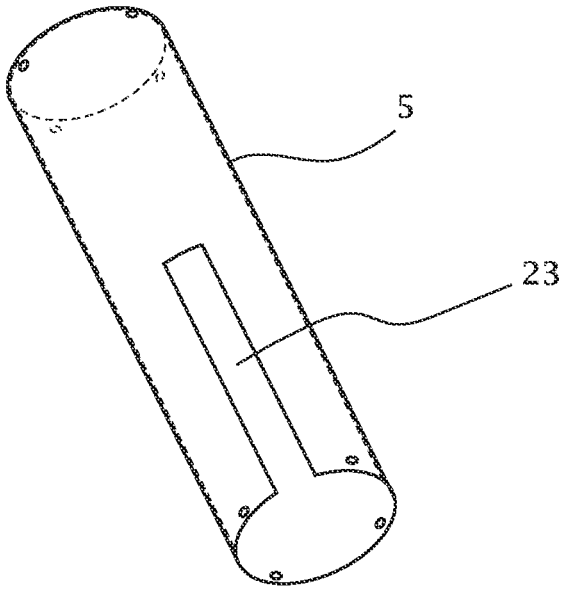
FIG. 5*a* illustrates the U-shaped cut-out of the lower tubular element 5.
Figure 5B:
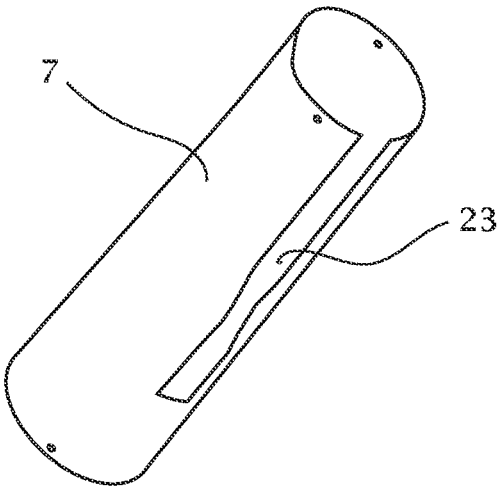
FIG. 5*b* illustrates the U-shaped cut-out of the upper tubular element 7.
Figure 6:
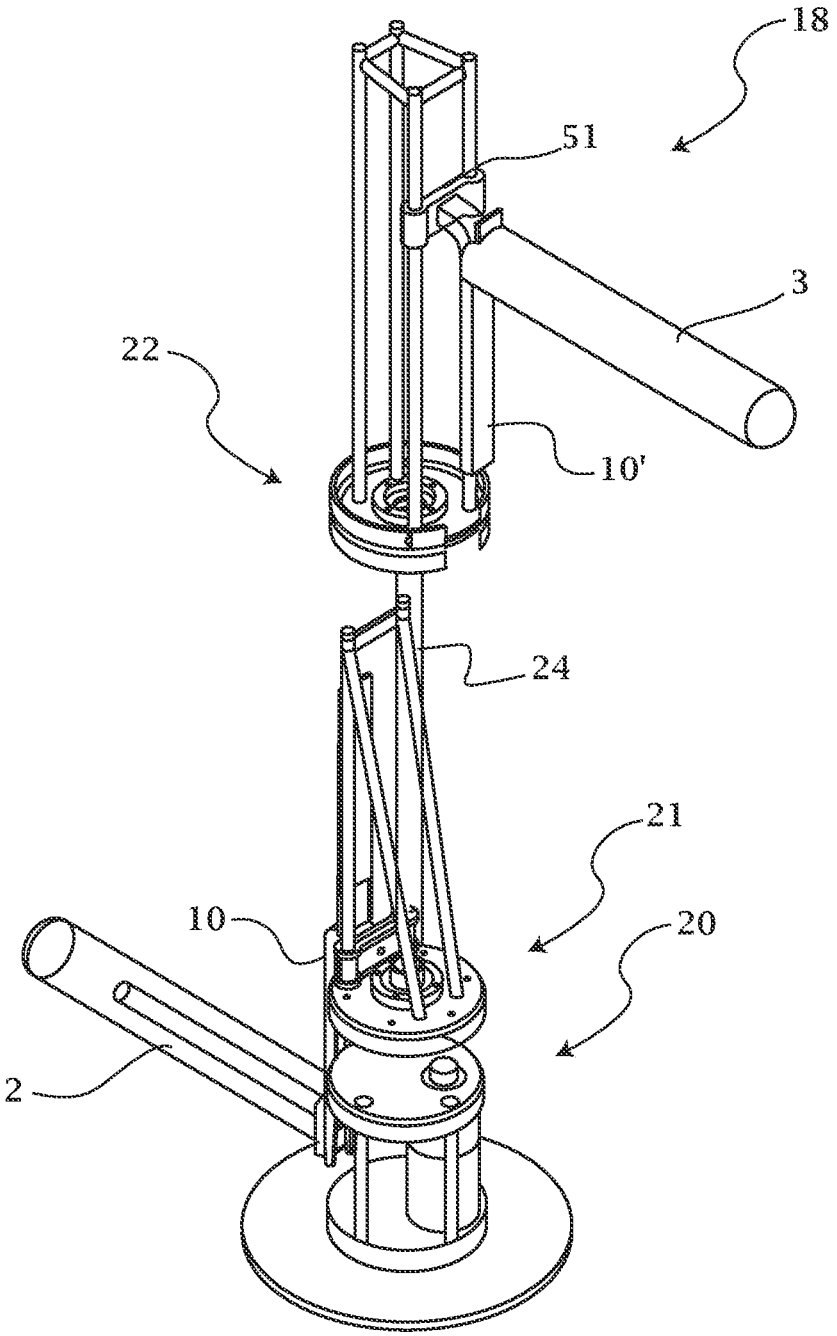
FIG. 6 is an axonometric view of the inner body 18.

In FIG. 5, the adjustment of the suspension height of the obstacles 2 and 3 is shown with a dotted line by sliding the sliding means 10 bearing the lower obstacle 2 upwards along the lower tubular element 5 and respectively by sliding the sliding means 10' bearing the upper obstacle 3, down the length of the upper tubular element 7 bearing the upper obstacle 3. For this purpose, both the lower tubular element 5 and the upper tubular element 6 are provided with a U-shaped slot 23 (FIGS. 5*a* and 5*b*) with a width corresponding to of the width of the sliding means 10,10' passing through the slots 23 during the adjustment and with a length corresponding to the selected adjustment tolerance, respectively to the lower obstacle 2 and/or to the upper obstacle 3, as the chosen adjustment tolerance in both cases being defined by the length of the sliding means 10, 10" and in this case is in the range from 0 to 400 mm As can be seen in FIGS. 5 and 6, the inner body 18 (FIG. 6) represents a general arrangement of the functional elements adjacent to each of the tubular elements 4, 5 and 7 and situated in the cavities 4',5' and 7' (FIG. 5), defined by them, as provides the targeted movements of both the tubular elements 5 and 7 and the obstacles 2 and 3 connected, as already was mentioned, with the inner body 18 by the sliding means 10,10'. It is important to note here that the connection of the sliding means 10,10' with the indoor body 18 is a bolt connection (not shown), which means that it is also detachable with respect to the device 1 according to the invention, which further increases the adjustment range of the height for attachment of the obstacles 2 and 3, i.e. from 400 to 800 mm. By functional elements here is meant a base chassis 20 located in the base of the device 1 according to the invention, in the cavity 4' defined by the fixed tubular element 4, a lower sub-frame 21 located above the base chassis 20, in the cavity 5' defined from the lower tubular element 5 and the upper sub-frame 22 located above the lower sub-frame 21, in the cavity 7' defined by the upper tubular element 7 and connected to the lower sub-frame 21 by a spindle 24.

Figure 7:
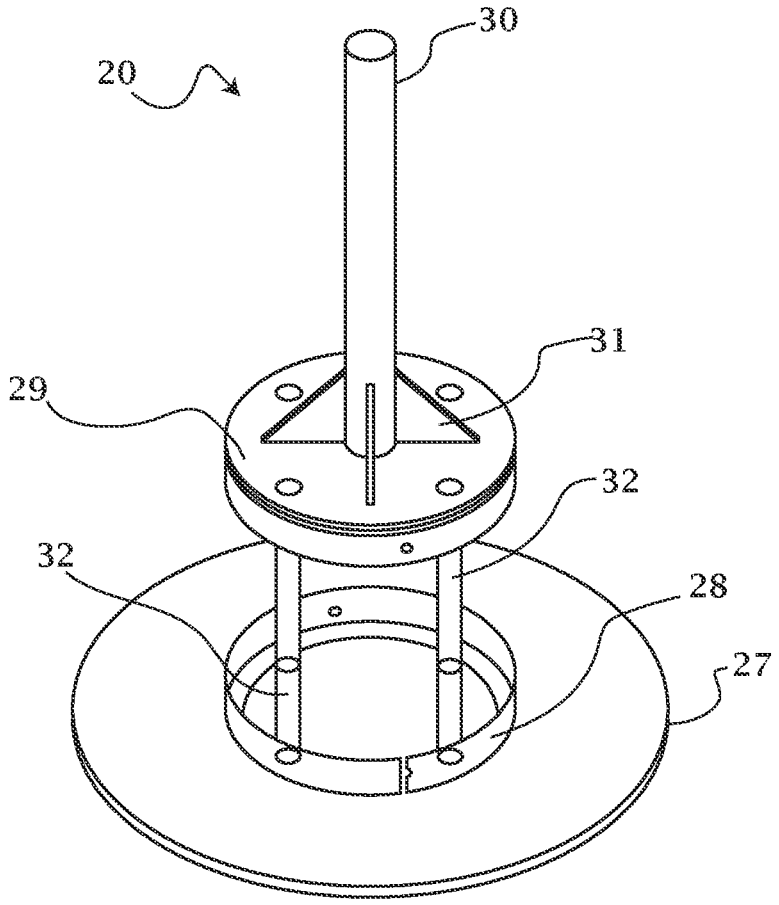
FIG. 7 is a perspective view of the main support chassis 20.

The main supporting chassis 20 (FIGS. 5 and 7) is designed for mounting the drive system of the inner body 18, the motor 25 and the gear 26, symbolically shown, transforming the movement of the motor shaft into a rotational movement given to the lower sub-frame 21 and the associated with it functional elements and spindle 24. For the mounting of the motor 25 are provided a base plate 27 in the form of a cylindrical disk, a limiting ring 28 disposed on the base plate 27, a motor mounting plate 29 connected to a support beam 30 by means an angular connection pipe-plate 31 and a pair of legs 32, connected, from one side, with the limiting ring 28, and on the other side, with the motor mounting plate 29.

Figure 8:
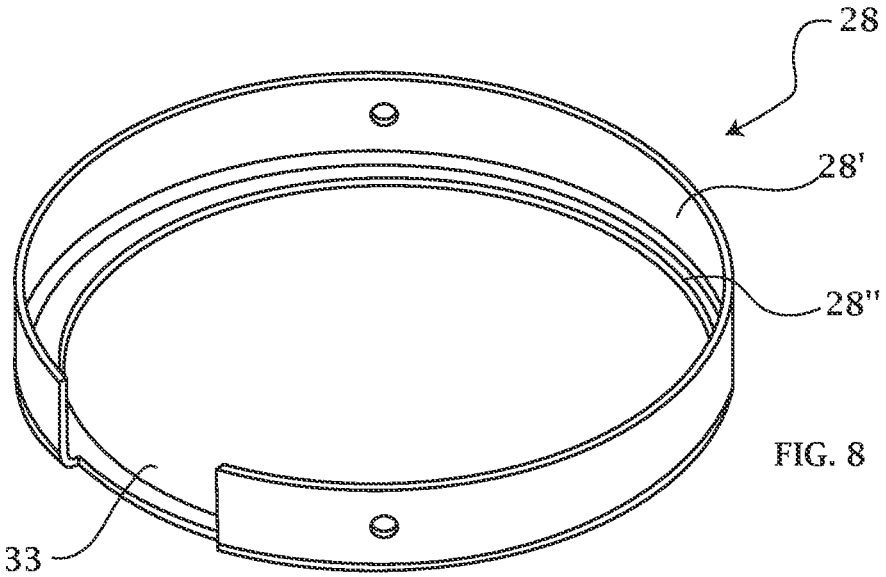
FIG. 8 is a perspective view of the ring 28.

In FIG. 8, the limiting ring 28 is shown on an enlarged scale and can be seen that it is composed of a vertically standing ring 28' and a second 28" lying at a 90 degree angle to it, designated for fastening the ring 28 to the base plate 27. The vertical ring 28' is provided with a cut-out 33 designated to take the end of the sliding means 10 when sliding it down to adjust the suspension height of the lower obstacle 2 by sliding the sliding means 10. It is important to note that the shape and dimensions of the cut-out 33 correspond to the shape and dimensions of that part of the sliding means 10 which passes through it when adjusting the height in the range from 400 to 800 mm.

Figure 9:
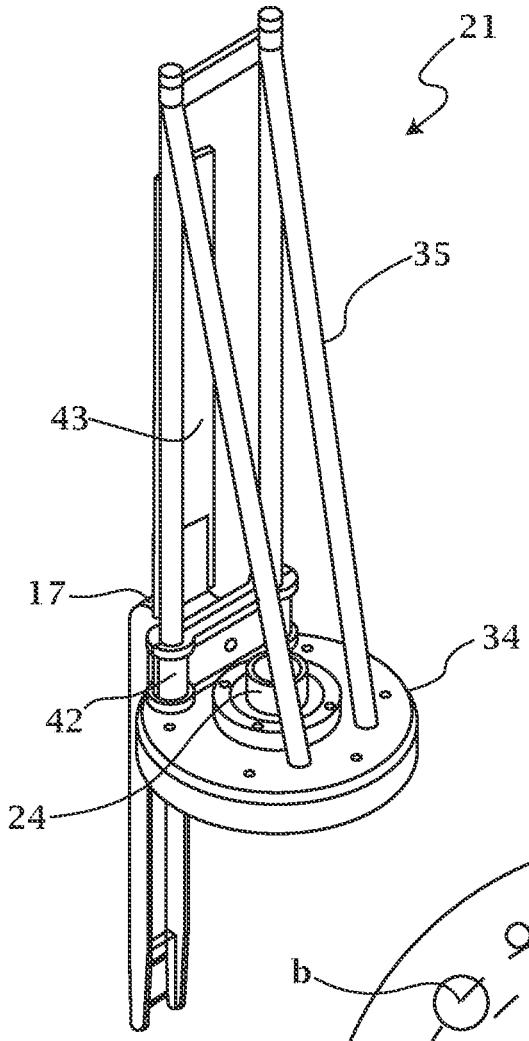
FIG. 9 is a perspective view of the lower sub-frame 21.
Figure 11:
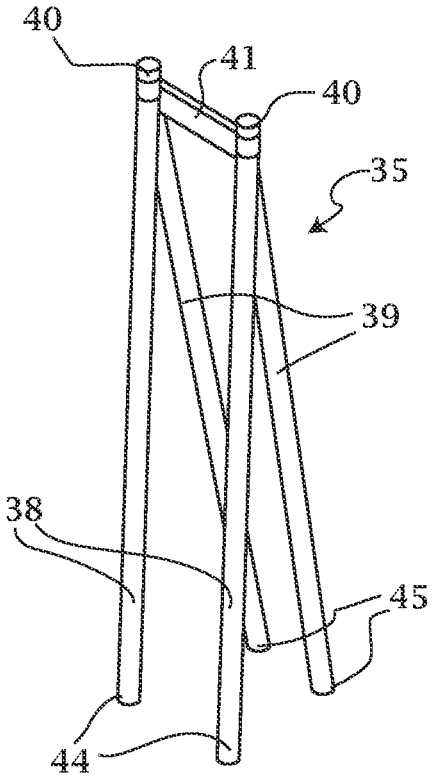
FIG. 11 is a perspective view of the welded structure 35.

As already mentioned, the lower sub-frame 21 is disposed in the cavity 5', defined by the lower tubular element 5 and is intended to receive the rotational motion given thereto by the gear 26 transforming the translational motion of the motor into a rotary, generally known from the above-mentioned prior art, incorporated herein by the reference or other gear for the same purpose without to come out from the scope of the present invention. The rotational motion thus received is transmitted to the upper sub-frame 22 disposed in the cavity 7' of the upper tubular element 7 by the spindle 24. As shown in FIG. 9, the lower sub-frame 21 includes: a base plate 34 to which the lower end of the lower tubular member 3 is attached, so that a common rotating structure is obtained. The base plate 34 is shown in more detail, on an enlarged scale in FIG. 10. On the base plate 34 is disposed a welded structure 35 made of mild steel, shown in more detail in FIG. 11. The base plate 34 is provided with a central opening 36 for fixing in it the spindle 24 for connection to the upper sub-frame 22 and giving the rotational movement both to it and to the associated lower tubular element 5.

The welded structure 35 (FIGS. 9 and 11) is composed of a pair of vertical tubes 38 and a U-shaped truss 39 connected with them. The free end 40 of each vertical pipe, from the pair of vertical pipes 38, is connected to the crossbeam 41 of the U-shaped truss 39 in the place of their corresponding ends of the truss 39 by welding. In the base of the pair of vertical tubes 38 (FIG. 9) a slider 42 is inserted so that it can move upwards along their length. The slider 42 is connected to the short arm 17 of the sliding means 10 carrying the lower obstacle 2 by means of a screw connection (not shown), which allows manual selection of the height of the suspension of the obstacle in accordance with the wishes of the trainee. Right behind the slider 42, a guard rail 43 is provided for the window 23 formed by the cut-out in the lower tubular element 5 for the purpose of adjusting the suspension height of the lower obstacle 2.

Figure 10:
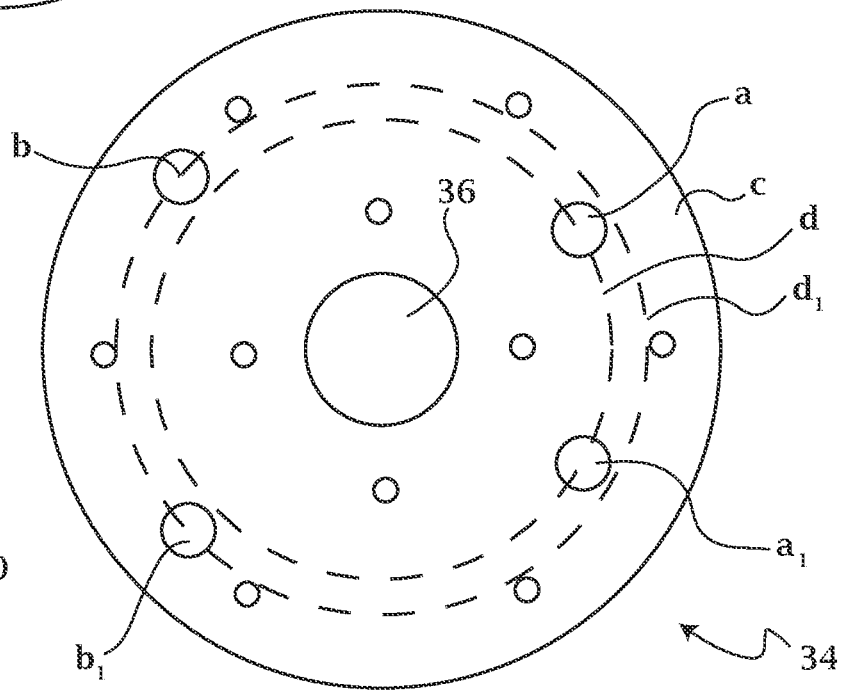
FIG. 10 is a top view of the base plate 34 of the sub-frame 21.

As can be seen in FIG. 10, the base plate 34 is in the form of a cylindrical disk, in the center of which a central opening 36 is provided for accommodating the spindle 24 therein. Also provided are a pair of holes $a$-$a_1$ disposed at one end of the base plate 34 for accommodating in them the lower ends 44 (FIG. 11) of the pair of vertical tubes 38 welded thereto by welding and a pair of holes $b$-$b_1$, disposed opposite the openings $a$-$a_1$ at the opposite end of the base plate 34 for accommodating in them the lower ends 45 of the U-shaped truss 39, welded in them by welding. The angular distance between the openings "a" and "$a_1$", the angular distance between the openings "b" and "$b_1$", the distance between the peripheral circle "c" of the base plate 34 and the imaginary circle "d" passing through the center of the openings "a" and "$a_1$" for the accommodation in them the lower ends 44 of the pair of vertical bars 38, and the distance between the peripheral circle "c" of the base plate 34 and the imaginary circle "$d_1$" passing through the center of the holes "b" and "$b_1$", for accommodation in them the lower ends 45 of the U-shaped truss 39 are so set that the cross beam 41 of the U-shaped truss 39 to reach and rests on the upper ends 40 of the pair of vertical pipes 38 where it is welded.

In FIG. 12 is shown ½ of the slider 42 to see its internal performance. It has a housing 46 in the shape of a parallelepiped, designed for attaching the sliding means 10,10' to it, as the two ends of the housing 46 grow into clamping parts 47 in the form of cylinders, in which lie the vertical tubes of the pair of vertical tubes 38. The inner surface of each of the clamping cylinders 47 is provided with a soft sleeve 48 to ease the sliding, when the slider moves along the vertical tubes 38, which is glued with an adhesive suitable for cylindrical gluing with a high-strength and fast drying, such as LOCTITE®638 of Henkel, designed for connecting cylindrical fittings with clearances up to 0.25 mm.

As mentioned, the upper sub-frame 22 of the inner body 18, shown in more detail in FIG. 13 is located in the cavity 7', defined by the upper tubular element 7 and is intended for attaching to it the upper obstacle 3 and the upper tubular element 7 itself. The upper sub-frame 22 includes an upper base plate 49 with a limiting ring to its periphery 37 designed for attachment to it the lower end of the upper tubular element 7. A second welded structure 50 is disposed on the upper base plate 49. To the second welded structure 50 is mounted a second slider 51 (FIG. 6), structurally equivalent to the slider 42 mounted on the pair of vertical bars 38 of the lower sub-frame 21 of the inner body 18. It is important to note that the second slider 51 is diametrically opposed disposed relative to the slider 42 of the lower sub-frame 21 and is connected to a second sliding means 10', structurally equivalent to the sliding means 10, by a detachable bolt connection (not shown) for adjusting the suspension height of the upper obstacle 3, by changing the attachment place of the sliding means 10' to the second slider 51.

The second welded structure 50 is composed of two pairs of tubular rods, a first pair 52 and a second pair 52', standing parallel to each other and at a distance from each other, defined by openings $a_2$-$a_3$ and $b_2$-$b_3$ (FIG. 14) for fastening their lower ends to the upper base plate 49. The upper ends of the two pairs of tubular rods 52 and 52' are connected to each other, in series, by means of crossbeams 53, so that the crossbeams 53 form a ring in the shape of an irregular a quadrangle 54. In the center of the upper base plate 49, an opening 55 is provided for mounting in it the spindle 24, whereby the rotational movement of the lower sub-frame 21 is transmitted to both the upper sub-frame 22 and the associated upper tubular element 7.

As mentioned, the periphery of the upper base plate 49 is provided with a limiting ring 56. In the limiting ring 56, a cut-out 57 is provided for passing the sliding means 10' through it when adjusting the suspension height of the upper obstacle 3. And in this case, the sliding means 10'(FIG. 6) is detachably connected to the second slider 51 via a screw connection (not shown).

The arrangement of the two pairs of openings $a_2$-$a_3$ and $b_2$-$b_3$, illustrated in FIG. 14, intended to be fastened thereto, for example by welding, to the lower free ends of the two pairs of tubular rods 52 and 52', corresponds to the arrangement of the irregular quadrilateral 54 formed by their upper ends as connected by the crossbeams 53, as the openings $a_2$-$a_3$ being adjacent to the cut-out 57 made in the limiting ring 55 and are intended to accommodate in them the lower ends of that of the two pairs of tubular rods 52, 52' to which the second slider 51 of the upper sub-frame 22 is attached. In the case of FIGS. 13 and 14, this is the pair of tubular rods 52, and for the openings $b_2$-$b_3$ these are the lower ends of the second pair of tubular rods 52'. The openings $a_2$-$a_3$ for the pair of tubular rods 52 are located near the cut-out 57 of the limiting ring 56, and the openings $b_2$-$b_3$ are located at the opposite end of the plate 49, as the angular distance between the openings $a_2$-$a_3$ being greater than that between openings $b_2$-$b_3$ and is chosen so as to obtain the irregular quadrilateral defined by the upper ends of the two pairs of tubular rods. Thus constructed, the welded structure 50 of the upper sub-frame 22 and the welded structure 35 of the lower sub-frame 34 provide the required diametrical arrangement of the sliders 42 and 51 and therefore the obstacles 2 and 3 carried by them, as well as the balance of the required vertical stability of the inner body 18 and respectively of the fitness device 1 according to the invention.

Example 2

Figure 15:
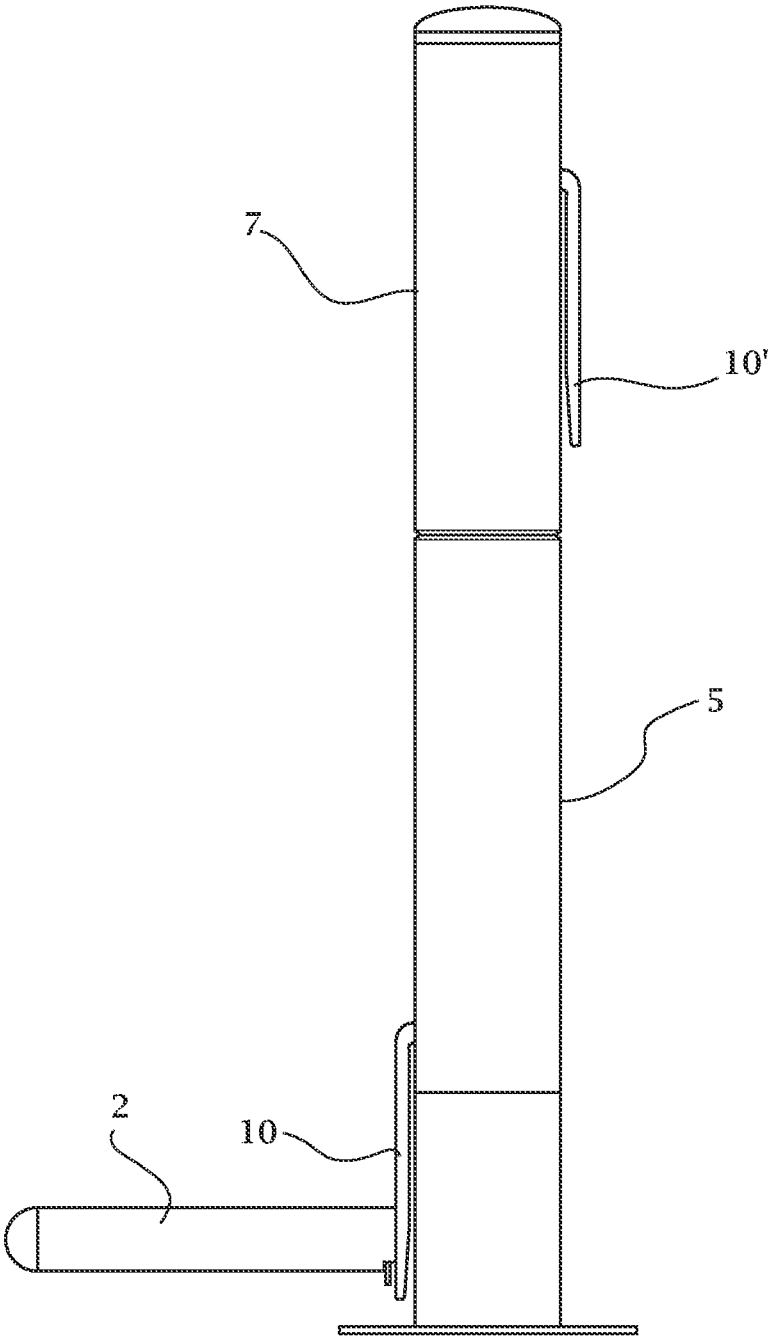
FIG. 15 is a general view of the fitness device 1 in "preparatory adaptation" mode with respect to the suspension height of obstacles 1 and 2, i.e. in non-operating mode of the device.

The possibility, the lower obstacle 2 and the upper obstacle 3 of the fitness device 1 according to the invention to be detachably attached to it, allows the device 1 to be used for "preparatory adaptation" to the movements, here called "jump" and "squat", which device 1 obliges the trainee to perform. By "preparatory adaptation" is meant here, for example, the assembly of only one of the obstacles 2 or 3 and the training of only one of the movements which the attached obstacle 2 or 3 obliges to be performed. In FIG. 15 illustrates the device 1 with only one of the obstacles attached to it: namely the lower obstacle 2, which, as is already known, obliges to perform a "jump". In this case, the trainee performs only jumps, as the time for arrival of the obstacle 2 to the training place is extended twice, which provides a calm approach to, and getting to know the device at the first contact with it. In this embodiment, the trainee can change the jump height by moving the magnet 14 along the long arm of the slider 10 within 0 to 400 mm, limited by its effective length, so that the trainee adapts to different heights of the jump and to choose the height that he will consider the most appropriate, in terms of strength and mental load when switching to the combination "jump-squat".

The device 1 according to the invention provides the same possibility for "preparatory adaptation" also with regard to the "squat" movement, in which only the upper obstacle 3 is attached to the device 1 and only squats are performed. Here, too, the trainee can change the suspension height of the upper obstacle 3 by moving the magnet 14 from 0 to 400 mm within the effective length of the arm 16 of the sliding means 10' to which it is attached to adapt and choose the height that would be most suitable for him, in terms of strength and mental load, when switching to the combination of "jump-squat". It follows from the foregoing that a so-called first possibility for adjusting the suspension height of obstacles 1 and 2 has been formed by moving the magnet 14 along the arm 16 of the sliding means 10,10' and more precisely, by changing the location of the "magnet-sliding means" magnetic connection.

A positive quality of the device according to the invention is that it also provides a second possibility for adjusting the height of the suspension of obstacles 1 and 2 by moving the sliders 42 and 51, to which the respective sliding means 10,10' is detachably attached, along the pair of vertical pipes 38 and respectively the tubular rods 52 and, more precisely, by changing the place of the detachable "sliding means-slider" connection, which change is again defined by the effective length of the sliding means 10,10' and is in the range from 0 to 400 mm.

It should be noted the abundant possibilities that the device according to the invention offers in terms of force diversification of the training process, through the two possibilities to change the suspension height adjustment of obstacles 1 and 2, for example only by changing the place of the connection "magnet-sliding means "in the range from 0 to 400 mm, or only by changing the place of the prefabricated connection" sliding means-slider" in the range from 0 to 400 mm or by applying both changes in the range from 0 to 2×400 mm.

The fitness device according to the invention operates as follows:

A. Preparatory actions:

the suspension height of the upper obstacle 3 is determined according to the height of the trainee or as a result of a "preparatory adaptation" performed by the trainee in one of the possible ways of adjusting the height described above, at the selected height the second slider 51 is screwed with the sliding means 10' attached to it and/or the magnet is attached to the sliding means 10', the suspension height of the lower obstacle 2 is determined according to the trainee's wish or as a result of a "preparatory adaptation" performed by the trainee in one of the possible ways of adjusting the height described above, at the selected height the slider 42 is locked with a screw with the sliding means 10 attached to it and/or the magnet 14 is attached to the sliding means 10.

In this situation, the device is ready for use.

B. Actual actions:

the trainee stands on the training place, which is a circular area around the axis 6 of the device 1, with a radius defined by the length of the lower and upper obstacles 2 and 3, respectively, i.e. with a radius in the range up to 200 mm and preferably 115 mm, the engine 25 is started, whereby the lower sub-frame 21 with the lower tubular element 3 attached to it and the lower obstacle 2 attached to the inner body 18 and the upper sub-frame 22 with the upper tubular element 7 attached to it, and attached to inner body 18 upper obstacle 3 start to rotate about the axis 6 of the device 1 in the same direction, arriving sequentially and alternately in the training place/not shown/, where the trainer makes a jump, when the lower obstacle 2 reaches at him and performs squatting, when the upper obstacle 3 reaches at him, in continuously repeated cycles "jump-squat".

Literature Cited in the Description

1. U.S. Pat. No. 10,188,889;
2. Utility model registration certificate BG No. 3275 U1

LIST OF DESIGNATIONS

1—fitness device for training the whole body;
2—lower detachable obstacle;
3—upper detachable obstacle;
4—fixed tubular element;
4'—a cavity defined by the fixed tubular element;
5—lower tubular element with the possibility of rotation;
5'—cavity defined by the lower tubular element
6—vertical axis of the device 1;
7—upper tubular element with the possibility of rotation;
7'—a cavity defined by the upper tubular element;
8—cover of the device 1;
9—main base plate of the device 1;
10-10'—sliding means;
11—neck of the lid;
12—openings on the main base plate 9
13—tubular arm of obstacles 2 and 3;
14—magnet of the tubular arm 13;
15—two-layer case;
16—a long arm of the sliding means 10;
17—short arm of the sliding means 10;
18—inner body of the device 1;
19—plate for fastening the short arm 17;
20—base chassis of the inner body 18;
2—lower sub-frame of the inner body 18;
22—upper sub-frame of the indoor unit 18;
23—U-shaped slot of the lower and upper tubular elements 5 and 7;
24—spindle
25—drive motor;
26—gear
27—base plate for the drive motor 25;
28—limiting ring;
28'-28"—parts of the ring 28
29—plate for mounting the gear;
30—supporting beam;
31—angular pipe-plate connection
32—pair of legs;
33—cut-out in the ring 28;
34—base plate of the lower sub-frame 21;
35—welded structure;
36—central opening of the base plate 35;
37—a limiting ring of the upper base plate 49;
38—pair of vertical pipes of the welded structure 35
39—U-shaped truss;
40—free end of the vertical pipes;
41—cross beam;
42—slider;
43—safety rail;
44—lower ends of the vertical pipes;
45—lower ends of the U-shaped truss;
46—slider housing 42;
47—clamping cylinders;
48—sleeve of the clamping cylinders;
49—upper base plate of the sub-frame 22;
50—second welded structure;
51—second slider;
52-52'—two pairs of tubular rods;
53—cross beams;
54—ring in the shape of an irregular quadrangle;
55—central opening of the base plate 49;
56—limiting ring on the base plate 49;
57—cut-out of the limiting ring;

The invention claimed is:

1. A fitness device for training the whole body by jumps and squats from place, comprising:
a main base plate defining a space for fixing the device,
a lower obstacle and an upper obstacles performing unidirectional rotational movement around the vertical axis of the device arranged diametrically opposite to each other at an angle of 180° and vertically spaced at a distance commensurate with human height,
coaxially disposed one above the other, a fixed tubular element, a lower tubular element and an upper tubular element, each having a circumference with the same diameter,
an inner body disposed in cavities defined by the tubular elements,
a drive motor disposed at a base of the device, providing the rotational movement of the lower tubular element and of a part of the inner body that is present in the cavity defined by the lower tubular element, via a gear connected to a shaft of the drive motor, and
a cover disposed internally at an open end of the upper tubular element, wherein
the lower obstacle is magnetically connected to a first sliding means and the upper obstacle is magnetically connected to a second sliding means, and
the first sliding means and the second sliding means are detachably connected to the inner body.

2. The device according to claim 1, wherein:
the lower obstacle and the upper obstacle have an identical construction, comprising a tubular arm, one end of which is provided with a magnet, and
a two-layer case having a sponge disposed around the tubular arm and partially outside a free end of the tubular arm, and covered with leather or fabric, a total length of the obstacle being in the range of 100-120 mm.

3. The device according to claim 2, wherein:
each of the first sliding means and the second sliding means comprises an L-shaped body having a long arm in the shape of a parallelepiped and a short arm in the same shape, the arms being connected monolithically at 90 degree angle,
the long arm has a length of not more than 400 mm,
the magnet of the upper obstacle or the lower obstacle is attachable to the long arm in accordance with a selected height for suspension of the obstacle, and
a front surface of the short arm is provided with a plate for connection to the inner body.

4. The device according to claim 3, wherein the L-shaped body is made of low carbon steel.

5. The device according to claim 3, wherein the lower tubular element and the upper tubular element are provided with a U-shaped slot with a width and length corresponding to the width and length of the long arm.

6. The device according to claim 1, wherein the inner body comprises a base chassis disposed in the cavity defined by the fixed tubular element, a lower sub-frame disposed in the cavity defined by the lower tubular element, and an upper sub-frame disposed in the cavity defined by the upper tubular element.

7. The device according to claim 6, wherein the base chassis comprises a mounting kit for the drive motor having a base plate, a limiting ring disposed on the base plate, a mounting plate for the gear that is connected to a support beam by an angular connection pipe-plate and a pair of legs connected on one side to the limiting ring and on an other side to the mounting plate.

8. The device according to claim 7, wherein the limiting ring includes a first ring part standing vertically; and provided with a slot for accommodating the sliding means, and a second ring part disposed at 90 degree angle to the first ring part and fastened to the base plate.

9. The device according to claim 6, wherein the lower sub-frame comprises a lower base plate receiving the rotational movement from the gear, a welded structure connected to the lower base plate, and a spindle disposed in a central opening of the base plate, to a periphery of which is attached a lower end of the lower tubular element.

10. The device according to claim 9, wherein the welded structure comprises:

a pair of vertical tubes having lower ends disposed in clamping cylinders of a first slider and welded in corresponding holes of the lower base plate, and a U-shaped truss having lower ends welded in corresponding openings of the lower base plate, wherein an angular distance between the openings, an angular distance between the holes, an distance between a peripheral circles of the base plate and an imaginary circle passing through the center of the openings and a distance between the peripheral circle of the base plate and the imaginary circle passing through the center of the holes are set so that a crossbeam of the U-shaped truss is monolithically connected to upper ends of the pair of vertical tubes.

11. The device according to claim 6, wherein the upper sub-frame comprises:

an upper base plate with a central opening, a limiting ring connected to the lower end of the upper tubular element and receiving a spindle within the central opening, a second welded structure disposed on the base plate and provided with a second slider detachably connected to the second sliding means and disposed diametrically opposite to a first slider from of the lower sub-frame, wherein the limiting ring is provided with a cut-out corresponding to a place of attachment of the second slider.

12. The device according to claim 11, wherein the second welded structure comprises:

a first pair of tubular rods and a second pair of tubular rods arranged parallel to each other and at a distance defined by a first pair of openings and a second pair of openings on the upper base plate, wherein lower ends of the first pair of tubular rods are welded in the first pair of openings, lower ends of the second pair of tubular rods are welded in the second pair of openings, upper ends of the two pairs of tubular rods are connected to each other in series by transverse beams, the transverse beams forming a ring in the shape of an irregular quadrilateral defined by the arrangement of the first pair of openings with respect to the cut-out.

13. The device according to claim 1, wherein:

an adjustment of a suspension height of each obstacle is customizable and manually performed by a trainee by changing a location of a coupling between the obstacle and the sliding means and/or changing a location of a coupling between the sliding means and a slider, a first range of the adjustment is a function of the length of the long arm of the sliding means, and is in a range from 0 to 400 mm, and a second range of the adjustment is a function of the length of the long arm and a vertical position of the slider, and is in a range from 0 to 800 mm.

* * * * *